US009884508B2

(12) United States Patent
Hoshino

(10) Patent No.: US 9,884,508 B2
(45) Date of Patent: Feb. 6, 2018

(54) WRITING INSTRUMENT AND INK CARTRIDGE

(71) Applicant: Kabushiki Kaisha Pilot Corporation, Tokyo (JP)

(72) Inventor: Takanori Hoshino, Nagoya (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 182 days.

(21) Appl. No.: 14/777,840

(22) PCT Filed: Mar. 17, 2014

(86) PCT No.: PCT/JP2014/057196
§ 371 (c)(1),
(2) Date: Sep. 17, 2015

(87) PCT Pub. No.: WO2014/148445
PCT Pub. Date: Sep. 25, 2014

(65) Prior Publication Data

US 2016/0288561 A1 Oct. 6, 2016

(30) Foreign Application Priority Data

Mar. 20, 2013 (JP) ..... 2013-057430
Apr. 23, 2013 (JP) ..... 2013-089980
Jun. 28, 2013 (JP) ..... 2013-135671

(51) Int. Cl.
*B43K 8/06* (2006.01)
*B43K 5/14* (2006.01)
(Continued)

(52) U.S. Cl.
CPC ..... *B43K 5/145* (2013.01); *B43K 5/14* (2013.01); *B43K 5/1827* (2013.01); *B43K 7/02* (2013.01);
(Continued)

(58) Field of Classification Search
CPC . B43K 8/022; B43K 8/03; B43K 8/04; B43K 7/02; B43K 7/10
See application file for complete search history.

(56) References Cited

U.S. PATENT DOCUMENTS 2,061,059 A 11/1936 Carlson
3,645,636 A 2/1972 Mutschler
(Continued)

FOREIGN PATENT DOCUMENTS

CN 101224690 A 7/2008
DE 674850 C 4/1939
(Continued)

*Primary Examiner* — Jennifer C Chiang
(74) *Attorney, Agent, or Firm* — The Webb Law Firm

(57) ABSTRACT

A writing instrument includes: a writing instrument body and an ink cartridge. The ink cartridge includes a bottomed cylindrical container with an opened front end and a plug fitted into an inner circumferential surface of an opening of the container. The writing instrument body includes a projection that opens the ink cartridge when inserted into the opening to press the plug rearward and an air tight connecting portion, formed separately from the projection, that surrounds the projection. The opening is divided into a plurality of openings by air tight fitting the opening in the air tight connecting portion. A plurality of longitudinal channels are formed on an outer periphery of the projection. At least one of the plurality of channels serves as an ink channel and at least one of the other channels serves as an air intake path.

21 Claims, 8 Drawing Sheets

(51) Int. Cl.

| | |
|---|---|
| ***B43K 7/02*** | (2006.01) |
| ***B43K 7/10*** | (2006.01) |
| ***B43K 8/02*** | (2006.01) |
| ***B43K 8/03*** | (2006.01) |
| ***B43K 8/04*** | (2006.01) |
| ***B43K 5/18*** | (2006.01) |

(52) U.S. Cl.
CPC ..... *B43K 7/10* (2013.01); *B43K 8/022* (2013.01); *B43K 8/03* (2013.01); *B43K 8/04* (2013.01)

(56) References Cited

U.S. PATENT DOCUMENTS

| | | | |
|---|---|---|---|
| 4,712,937 | A | 12/1987 | Schmidt et al. |
| 6,155,734 | A | 12/2000 | Kageyama et al. |
| 2008/0193197 | A1 | 8/2008 | Iwasa et al. |
| 2009/0116895 | A1 | 5/2009 | Uehara et al. |
| 2009/0269122 | A1 | 10/2009 | Akiyama |

FOREIGN PATENT DOCUMENTS

| | | | |
|---|---|---|---|
| DE | 2211012 | A1 | 9/1973 |
| FR | 1078557 | A | 11/1954 |
| FR | 1355203 | A | 3/1964 |
| GB | 2160479 | A | 12/1985 |
| JP | S445167 | | 3/1964 |
| JP | S5663577 | U | 5/1981 |
| JP | 288792 | U | 7/1990 |
| JP | H0639480 | U | 5/1994 |
| JP | 2513818 | Y2 | 10/1996 |
| JP | 2005304547 | A | 11/2005 |
| JP | 2012206383 | A | 10/2012 |
| TW | 413238 | U | 11/2000 |
| WO | 2007043555 | A1 | 4/2007 |

WRITING INSTRUMENT AND INK CARTRIDGE

CROSS-REFERENCE TO RELATED APPLICATIONS

This application is the United States national phase of International Application No. PCT/JP2014/057196 filed Mar. 17, 2014 and claims priority to Japanese Patent Application Nos. 2013-057430, 2013-089980, and 2013-135671, filed Mar. 20, 2013, Apr. 23, 2013, and Jun. 28, 2013, respectively, the disclosures of which are hereby incorporated in their entirety by reference.

BACKGROUND OF THE INVENTION

Technical Field

The present invention relates to a writing instrument and an ink cartridge used for the same. Specifically, it relates to a writing instrument using a replaceable ink cartridge.

Background Art

Conventionally, for writing instruments having a built-in replaceable ink cartridge, an ink cartridge that directly stores ink in a container having one open end and has an opening blocked by a ball or a plug in a disk shape is widely used. In such ink cartridge, by engaging an ink-guidable tubular projection formed with a writing instrument body from a front end opening for connection, the plug is press-opened. When the plug is press-opened, ink in the ink cartridge is supplied to a pen point through the inside of the tubular projection (e.g., through hole). At this time, air is supplied from the pen point side into the container, thereby keeping the internal pressure of the ink cartridge in equilibrium to carry out stable ink supply (for example, refer to Patent Documents 3 and 4).

With a conventional tubular projection having a general purpose structure, it is difficult to let air enter the container and the ink supply is unstable. Then, attempts are made to form air intake paths inside the tubular projection (for example, refer to Patent Documents 1 and 2).

Patent Documents 1 and 2 describe writing instruments that have longitudinally extending slits formed in an inner circumferential wall of a tubular projection. The slits act as air intake paths. The slit-like air intake paths are intended to facilitate air flow into the ink cartridge. However, because the thickness of the wall portion constituting the tubular projection is thin, the slit-like air intake paths formed in the inner surface of the wall portion are fine. Further, the slit-like air intake paths continue to the through hole in the tubular projection to be an ink channel. The slit-like air intake paths are, therefore, prone to be in a fluid tight condition due to the ink. As just described, in the slit-like air intake paths, it is difficult to obtain a sufficient air flow because the fluid tight condition interferes with the inflow of air.

Patent Documents 3 and 4 describe writing instruments that have a configuration in which, when the plug is pressed, the ink cartridge is in a connected condition and the outer peripheral surface of the tubular projection air tight fits the inner circumferential surface of the opening of the ink cartridge. The tubular projection air tight fits the opening of the ink cartridge, thereby inhibiting ink leakage in the connected condition of the ink cartridge 6. Patent Document 4 also describes that, in addition to the air tight fitting configuration, locking bumps are provided on the outer peripheral surface of the opening of the ink cartridge and slitted locking portions are formed in the writing instrument body. Even when the air tight fitting turns out becomes looser over time, it is possible to inhibit ink cartridge drop-out by such locking bumps and slitted locking portions.

In the air tight fitting configuration described in Patent Documents 3 and 4, the tubular projection fits inside the opening of the ink cartridge, thereby forming the air tight condition. Therefore, the inner diameter of the through hole of the tubular projection that serves both as an ink channel and an air intake path turns out to be small. As a result, it is difficult to let air enter the ink cartridge and ink supply to the pen point side becomes unstable. In particular, when the outer diameter of the writing instrument is narrow, the ink cartridge and the outer diameter of the tubular projection are also narrow, so that the inner diameter of the through hole of the tubular projection turns out to be smaller. Therefore, in the writing instruments of Patent Documents 3 and 4, ink supply becomes more unstable.

The writing instrument described in Patent Document 4 also has a configuration in which, when the tubular projection air tight fits in the opening of the ink cartridge, the slitted locking portions of the writing instrument body fit over the locking bumps of the ink cartridge. When the ink cartridge is attached, the ink cartridge therefore does not deflect and thus requires a large pressing force. On the other hand, when the ink cartridge is detached, the ink cartridge has to be pulled out swiftly and there is a risk of causing scattering of residual ink and the like at that time.

Further, it is possible to repeatedly use the writing instruments described in Patent Documents 1 and 5 by replacing the empty ink cartridge after ink consumption.

The writing instruments described in Patent Documents 1 and 5 are provided with an intermediate member equipped with a tubular projection as a connecting portion to an ink cartridge. The intermediate member is fitted in the inner surface of a barrel that constitutes the writing instrument body. With the writing instrument described in Patent Documents 1 and 5, there is a risk that, when the empty ink cartridge is replaced, the intermediate member rotates together with the ink cartridge and that the intermediate member easily come out of the inner surface of the barrel.

PRIOR ART DOCUMENTS

Patent Documents

Patent Document 1: Japanese Utility Model No. 2513818

Patent Document 2: Japanese Patent Publication No. S44-5167

Patent Document 3: Japanese Utility Model Application Kokai Publication No. H6-39480

Patent Document 4: Japanese Utility Model Application Kokai Publication No. H2-88792

Patent Document 5: Japanese Utility Model Application Kokai Publication No. S56-63577

SUMMARY OF THE INVENTION

Problems to be Solved by the Invention

The present invention provides a writing instrument that is capable of always stably supplying ink from inside an ink cartridge to a pen point side and taking in air from the pen point side into the ink cartridge and exhibits good writing performance without causing scratchy handwriting and the like.

The present invention also provides a writing instrument that is capable of connecting an ink cartridge to a writing instrument body with an appropriate fitting force, capable of carrying out installation and removal of the ink cartridge with an appropriate degree of force without causing ink leakage while the cartridge is connected, and further, capable of securing a sufficiently large ink channel even if the writing instrument has a barrel with a narrow outer diameter, thus satisfying ink cartridge replacement performance and ink discharge performance.

Further, the present invention provides a writing instrument that is excellent in assembly retainability capable of inhibiting rotation of an intermediate member together with an ink cartridge and cartridge replaceability.

Means to Solve the Problems (1) The configuration of a writing instrument of the present invention includes: a writing instrument body provided with a pen point at a front end of a barrel; and an ink cartridge connected to a rear end side of the writing instrument body, wherein the ink cartridge includes a bottomed cylindrical container with an opened front end and a closed rear end and a plug fitted into an inner circumferential surface of an opening of the container, the writing instrument body includes a projection that opens the ink cartridge when inserted into the opening of the container to press the plug rearward and a connecting portion formed separately from the projection and also surrounding the projection, and the writing instrument body and the ink cartridge are in a connected condition by air tight fitting the opening of the container in the connecting portion.

(2) An embodiment according to a first aspect of the present invention has a configuration, in the writing instrument according to (1) above in which the opening of the container is divided into plurality by the projection to form a plurality of longitudinal channels in an outer periphery of the projection, where at least one of the channels serves as an ink channel and at least one of the other channels serves as an air intake path.

(3) It is preferred that the writing instrument according to (1) or (2) above may also have a configuration, in which the projection is provided with a plurality of longitudinal grooves on an outer peripheral surface.

(4) It is preferred that the writing instrument according to (3) above may also have a configuration in which each groove has an approximately identical radial cross sectional shape.

(5) An embodiment according to a second aspect of the present invention may also have a configuration, in the writing instrument according to (1) above in which the connected condition is achieved by air tight fitting an outer peripheral surface of the opening of the container in an inner side surface of the connecting portion.

(6) It is preferred that the writing instrument according to (5) above may also have a configuration in which the connecting portion is in an axially extending cylindrical shape.

(7) It is preferred that the writing instrument according to (6) above may also have a configuration in which an air tight annular rib is formed on the inner surface of the connecting portion and/or on the outer peripheral surface of the opening of the container.

(8) It is preferred that the writing instrument according to any one of (5) through (7) above may also have a configuration in which the opening of the container is divided into plurality by the projection to form a plurality of longitudinal channels on an outer periphery of the projection, at least one of the channels serve as an ink channel and at least one of the other channels serve as an air intake path.

(9) An embodiment according to a third aspect of the present invention has a configuration, in the writing instrument according to (1) above, in which an intermediate member is press fitted in the barrel in a cylindrical shape of the writing instrument body and the connecting portion is provided behind a fitting portion of the intermediate member, and a locking portion is formed in the intermediate member and also a locked portion is formed on an inner circumferential surface of the barrel, and when a rotating force is applied to the connecting portion, the locking portion makes contact with and locks the locked portion to restrict rotation of the intermediate member.

(10) It is preferred that the writing instrument according to (9) above may also have a configuration in which the locking portion and the locked portion are axially extending ribs.

(11) It is preferred that the writing instrument according to (10) above may also have a configuration in which a rotation preventing rib is formed in the intermediate member, a plurality of restricting ribs are formed radially on the inner circumferential surface of the barrel, and the rotation preventing rib is disposed between the adjacent restricting ribs.

(12) It is preferred that the writing instrument according to (10) above may also have a configuration in which a rotation preventing rib is formed on the inner circumferential surface of the barrel, a plurality of restricting ribs are formed radially in front of the fitting portion of the intermediate member, and the rotation preventing rib is disposed between the adjacent restricting ribs.

(13) It is preferred that the writing instrument according to (11) or (12) above may also have a configuration in which the restricting ribs are disposed radially at regular intervals on the inner circumferential surface of the barrel or the fitting portion of the intermediate member.

(14) It is preferred that the writing instrument according to any one of (11) through (13) above may also have a configuration in which a plurality of rotation preventing ribs is provided and disposed radially at regular intervals on the inner circumferential surface of the barrel or on the fitting portion of the intermediate member.

(15) It is preferred that the writing instrument according to any one of (9) through (14) above may also have a configuration in which the ink cartridge is screwed together with any one of the connecting portion, the intermediate member, and the barrel.

(16) It is preferred that the writing instrument according to any one of (1) through (15) above may also have a configuration in which an external thread is formed on any one of an inner surface of the barrel and an outer peripheral surface of the container and an internal thread is formed in the other, and air tight fitting of the connecting portion and the opening of the container proceeds in association with screwing of the external thread together with the internal thread.

(17) It is preferred that the writing instrument according to any one of (1) through (16) above may also have a configuration in which the pen point provided at a tip end of the barrel is a marking pen tip and an ink absorber is provided in the barrel.

(18) An ink cartridge according to a first aspect of the present invention is an ink cartridge constituting the writing instrument according to any one of (1) through (4) and (9) through (17) above having a configuration in which the opening of the container has an inner circumferential surface air tight fitting an outer side surface of the connecting portion.

(19) An ink cartridge according to a second aspect of the present invention is an ink cartridge constituting the writing instrument according to any one of (1) through (17) above having a configuration in which the opening of the container has an outer peripheral surface of air tight fitting an inner side surface of the connecting portion.

(20) An ink cartridge according to a third aspect of the present invention is an ink cartridge constituting the writing instrument according to (16) above having a configuration in which any one of the external thread or the internal thread is formed in the outer peripheral surface of the container.

(21) An ink cartridge according to a fourth aspect of the present invention is an ink cartridge constituting the writing instrument according to (17) above having a configuration in which an oil-based ink for writing board containing pigment, a resin, and a remover in a solvent is stored in the container.

In the present invention, "front" means the pen point side in the writing instrument and the opening side in the cartridge, and "rear" means the opposite side.

Effects of the Invention

In the writing instrument according to the first aspect of the present invention, when the ink cartridge is installed in the writing instrument body, an independent ink channel and independent air intake path that are sufficiently large are respectively formed in a non-continuous manner. Thus, in the writing instrument according to the first aspect of the present invention, the air intake path is not in a fluid tight condition due to the ink, and ink supply from inside the ink cartridge to the pen point side and air intake from the pen point side into the ink cartridge are carried out always stably. Consequently, according to the first aspect of the present invention, it is possible to provide a writing instrument that is capable of durably exhibiting good writing performance without causing scratchy handwriting and the like and that is excellent in ink discharge stability.

The writing instrument according to the first aspect of the present invention is also capable of having a large cross-sectional area of the air intake path formed with a simple structure, so that it is possible to securely prevent a fluid tight condition due to the ink.

In the writing instrument according to the second aspect of the present invention, it is possible form an airtight connection between the ink cartridge and the writing instrument body having an appropriate fitting force. Thus, in the writing instrument of the second aspect of the present invention, it is possible to carry out attachment and detachment of the ink cartridge with an appropriate degree of force without causing ink leakage while the ink cartridge is connected. Further, in the writing instrument of the second aspect of the present invention, even when the outer diameter of the barrel to which the ink cartridge is connected is narrow, it is possible to secure the ink channel and the air intake path that are sufficiently large inside the opening of the ink cartridge. Consequently, according to the second aspect of the present invention, it is possible to provide a writing instrument satisfying the ink cartridge replacement performance and the ink discharge performance.

Further, in the writing instrument of the second aspect of the present invention, the opening of the ink cartridge is divided into a plurality of openings by the projection. Thus, in the writing instrument according to the second aspect of the present invention, when the ink cartridge is installed in the writing instrument body, the ink channel and the air intake path that are sufficiently large are formed respectively and independently in a non-continuous manner. As a result, in the writing instrument according to the second aspect of the present invention, the air intake path is not in a fluid tight condition due to the ink, and the ink supply from inside the ink cartridge to the pen point side and the air intake from the pen point side into the ink cartridge are always carried out stably. Consequently, according to the second aspect of the present invention, it is possible to provide a writing instrument that is capable of durably exhibiting good writing performance without causing scratchy handwriting and the like and that is excellent in ink discharge stability.

In the writing instrument according to the third aspect of the present invention, even when the ink cartridge is rotated during installation and removal of the ink cartridge to and from the writing instrument body, it is possible to inhibit rotation of the intermediate member together with the ink cartridge. Consequently, according to the third aspect of the present invention, it is possible to provide a writing instrument that is capable of securely preventing the intermediate member fitted in the barrel from disengaging and that is excellent in assembly retainability and cartridge replaceability.

DESCRIPTION OF THE INVENTION

<embodiments According to First Aspect of the Invention>

Embodiments of a writing instrument and an ink cartridge according to a first aspect of the present invention are described with reference to the drawings. It should be noted that the first aspect of the present invention is not limited to embodiments described below.

Figure 1:
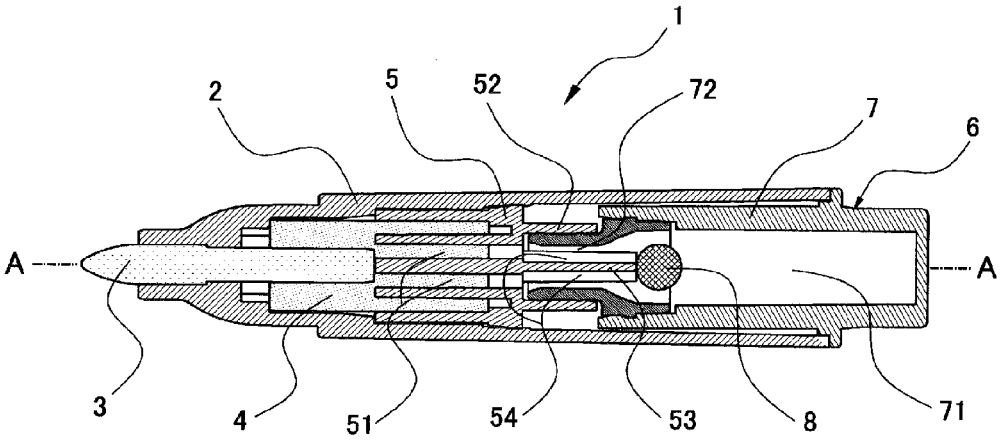
FIG. 1 is a cross-sectional view illustrating a first embodiment of a writing instrument according to a first aspect of the present invention.
Figure 2:
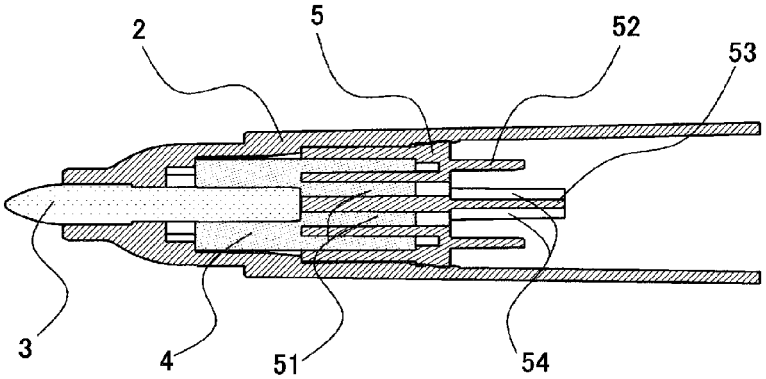
FIG. 2 is a cross-sectional view illustrating a writing instrument body constituting the writing instrument in FIG. 1.
Figure 3:
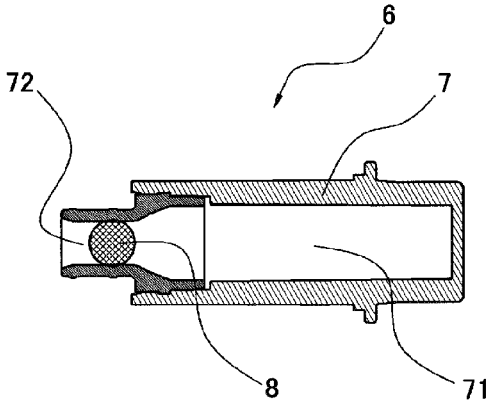
FIG. 3 is a cross-sectional view illustrating an ink cartridge constituting the writing instrument in FIG. 1.

A writing instrument 1 of the first embodiment shown in FIG. 1 is configured with a writing instrument body illustrated in FIG. 2 and an ink cartridge 6 depicted in FIG. 3. The writing instrument body has a configuration in which the pen point 3 to be a writing tip end is provided at the front end of a barrel 2 and an ink absorber 4 and an intermediate member 5 are arranged in the barrel 2. The ink cartridge 6 has a configuration in which ink is directly stored in a bottomed cylindrical container 7 that has an opening 72 blocked by a plug 8.

Figure 4:
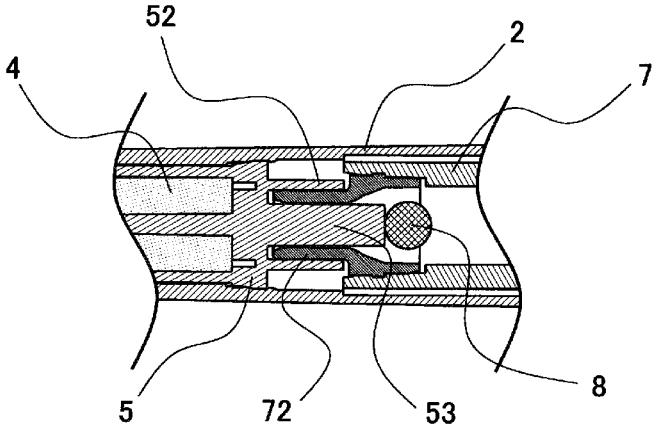
FIG. 4 is a cross-sectional view of major portions of the writing instrument in FIG. 1 taken from an A-A cross section.
Figure 5:
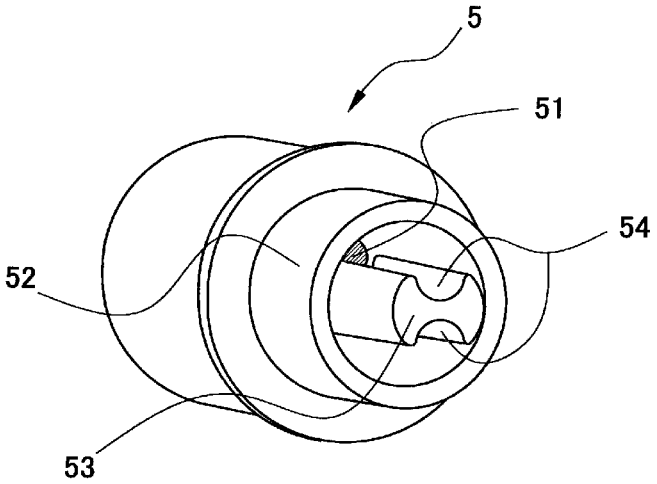
FIG. 5 is an enlarged perspective view of an intermediate member used for the writing instrument in FIG. 1.

The writing instrument 1 is a direct fluid type writing instrument. The barrel 2 of the writing instrument body is provided with the pen point 3, the ink absorber 4 connected to the rear end of the pen point 3, and the intermediate member 5 disposed behind the ink absorber 4. As illustrated in FIGS. 4 and 5, the intermediate member 5 is provided with an air tight connecting portion 52 and a projection 53 toward the rear. The barrel 2 is a cylindrical resin molding having an open rear end. The barrel 2 has a configuration of retaining the pen point 3 at the front end and also having the ink absorber 4 and the intermediate member 5 that are built in. Further, the writing instrument body and the ink cartridge 6 make the form of a writing instrument by fitting the ink cartridge 6 inserted into the open rear end area of the barrel 2 in the intermediate member 5.

The pen point 3 is a rod-like marking pen tip obtained by resin treatment of synthetic resin fiber (for example, polyester fiber, acrylic fiber, nylon fiber, and the like). While the front end of the pen point 3 is ground in a bullet shape, it is possible to apply those processed in a general purpose shape, such as a chisel shape. Further, as the pen point 3, it is also possible to use a ballpoint pen tip and the like as well as the marking pen tip.

The ink absorber 4 is made with a columnar object of synthetic resin fiber (for example, polyester fiber). The outer peripheral surface of the ink absorber 4 is coated with a cylindrical outer skin. The outer skin is made from a film of a synthetic resin (for example, film of polyethylene terephthalate). Hitting the axial center on the front end surface of the ink absorber 4, the rear end of the pen point 3 is located at the inside front of the ink absorber 4.

As the ink absorber 4, it is possible to use those for general purpose as long as they have a structure capable of retaining the ink temporarily. As the ink absorber 4, it is also possible to use an accordion-like ink holding member (pen core) and the like.

The barrel 2 is a tubular object obtained by injection molding of a synthetic resin (for example, polypropylene, polyethylene, and the like). The front end of the barrel 2 retaining the outer peripheral surface of the pen point 3 is tapered. The barrel 2 is molded as a single member from the front end to the opening area in the rear end. Further, inside the barrel 2, the ink absorber 4 and the intermediate member 5 are arranged. When the ink cartridge 6 is connected to the writing instrument body, the connected ink cartridge 6 is arranged inside the barrel 2.

As a specific structure, in the inner surface of the barrel 2, a plurality of longitudinally extending ribs are formed integrally. Press fitted to the outer peripheral surface of the ink absorber 4, the ribs retain the ink absorber 4. The barrel 2 also has ribs formed in the inner surface of the tapered portion. Press fitted to the outer peripheral surface of the pen point 3, the ribs retain the pen point 3.

The ribs forms air paths between the outer peripheral surface of the ink absorber 4 and the inner surface of the barrel 2 and between the outer peripheral surface of the pen point 3 and the inner surface of the tapered portion.

As illustrated in FIGS. 2, 4, and 5, the intermediate member 5 is obtained by injection molding of a synthetic resin (for example, polypropylene, polyethylene, and the like). The intermediate member 5 has an approximately disk-shaped partition wall that divides the ink absorber 4 from the ink cartridge 6. On the front surface of the partition wall, a plurality (for example, two) of communication pipes that project forward and hit inside the ink absorber 4 are formed. The communication pipes are provided axially with ink guiding portions 51. On the rear surface of the partition wall, the projection 53 that projects rearward and is inserted into the opening 72 of the ink cartridge 6 is formed. Further, on the rear surface of the partition wall, the tubular air tight connecting portion 52 that projects rearward and is formed to have the projection 53 located at the axial center is formed. The intermediate member 5 is constructed of one member provided with the partition wall, the communication pipes, the projection 53, and the air tight connecting portion 52. The intermediate member 5 is fixed by fitting the outer peripheral surface of the partition wall in the inner circumferential surface of the barrel 2.

In the writing instrument 1 of the present embodiment, annular ribs are formed on the outer peripheral surface of the ink cartridge 6 near the opening 72. The annular ribs are press fitted to the inner circumferential surface of the air tight connecting portion 52, thereby connecting and retaining the outer peripheral surface of the opening 72 of the ink cartridge 6 in an air tight condition. However, the writing instrument of the present invention is not limited to this configuration. This is not always necessary because it is also possible to use other structures with which ink leakage does not occur, such as a structure forming an air tight condition by fitting the outer peripheral surface of the projection 53 in the inner circumferential surface of the opening 72 of the ink cartridge 6 and a structure forming an air tight condition by press fitting the front surface of the opening 72 of the ink cartridge 6 to the partition wall of the intermediate member 5, for example. Further, it may also have a structure forming an air tight condition by fitting the outer peripheral surface of the air tight connecting portion 52 in the inner circumferential surface of the opening 72 of the ink cartridge 6 (refer to FIGS. 6, 7, and 8).

More detailed descriptions are given to a configuration of the intermediate member 5 with the cross-sectional view in FIG. 4 and the perspective view in FIG. 5.

As illustrated in FIG. 5, in the projection 53 of the intermediate member 5, longitudinally extending semicircular grooves (channels) 54 are formed. In the present embodiment, two grooves 54 are formed at vertically symmetrical positions in the projection 53. As illustrated in FIG. 4, when the projection 53 is inserted into the opening 72 of the ink cartridge 6, the outer peripheral surface of the projection 53, with the exception of the grooves 54, is in a condition of approximately fitting the inner circumferential surface of the opening 72. The grooves 54 have two through holes in communication with the ink guiding portions 51 formed in the end portion on the partition wall side. When the projection 53 fits the opening 72 of the ink cartridge 6, the plug 8 described later is opened. At this time, one of the two grooves 54 acts as an ink channel. The ink channel serves as a path to supply the ink in the ink cartridge 6 to the pen point 3 side. In addition, the other of the two grooves 54 acts as an air intake path. The air intake path serves as a path to let the air flow into the ink cartridge 6 from the pen point 3 side. With such a configuration, the internal pressure balance between the writing instrument body and the ink cartridge 6 is maintained.

By providing the two grooves 54 to be the ink channel and the air intake path in the outer surface of the projection 53, the opening 72 of the ink cartridge 6 is divided radially into a plurality of openings (in the present embodiment, two). Thus, the ink channel and the air intake path are formed respectively and independently without making contact with each other.

The approximately fitting condition of the projection 53 and the opening 72 described above encompasses conditions of tight contact on the approximately entire surfaces of the outer surface of the projection 53 and the inner surface of the opening 72, partial contact, and forming a minute gap between both surfaces (loose fitting). Therefore, when the projection 53 loosely fits the opening 72, large space channels formed by the two grooves 54 act as the ink channel and the air intake path in a substantially independent condition.

It should be noted that a configuration of letting the projection 53 and the opening 72 in the approximately fitting condition is a preferred embodiment of the writing instrument of the present invention. The writing instrument of the present invention is not limited to the configuration of letting the projection 53 and the opening 72 in the approximately fitting condition. Consequently, the writing instrument of the present invention includes a configuration of not fitting the projection 53 in the opening 72.

As illustrated in FIG. 3, the ink cartridge 6 is provided with the container 7, which is a bottomed cylindrical object with an opened front end and a closed rear end, and the opening 72 fitted in the opened area of the container 7. The container 7 is obtained by injection molding or blow molding of a synthetic resin (for example, polypropylene resin). The plug 8 is fitted into the inner wall of the opening 72. In addition, the interior of the container 7 is an ink storage portion 71. In the ink storage portion 71, oil based ink, for example, is directly stored (the ink is not shown). In the present embodiment, in order to tightly seal the inner circumferential surface of the opening 72 by the spherical plug 8, the opening 72 as a separate member is fitted in the opening of the container 7. As illustrated in FIG. 1, when the ink cartridge 6 is connected to the writing instrument body, the outer peripheral surface in the rear of the container 7 is fitted in the inner surface of the rear end of the barrel 2. The rear end of the container 7 is formed to be an end plug of the writing instrument 1. While the present embodiment has a configuration in which the outer peripheral surface in the rear of the container 7 fits the barrel 2 to connect the ink cartridge 6 to the writing instrument body, the writing instrument of the present invention is not limited to this configuration. For example, it is also possible to apply a connecting method where the ink cartridge 6 less likely to come off, such as screwing the container 7 together with the barrel 2. In addition, while a spherical object is used as the plug 8 in the present embodiment, the writing instrument of the present invention is not limited to this configuration. The plug 8 may be in a conventionally known form, such as in a disk shape and in a thin wall shape molded integrally with the opening 72, for example, as long as it is capable of being press-opened.

As the oil-based ink, as oil-based ink for writing boards is applied that uses, for example, ethanol and isopropyl alcohol as a solvent and contains an additive, such as pigment, a resin, and a remover. Oil-based inks for writing boards of such composition exhibit excellent in drying properties and erasability of handwriting when being written. The ink applied to the present invention is not limited to oil-based ink compositions for writing boards and may be oil-based inks that do not contain a remover or water-based inks containing water as a main solvent.

The ink cartridge 6 is inserted into the rear end opened area of the barrel 2 constituting the writing instrument body, and further, pressed forward. Thus, the rear end of the projection 53 presses the plug 8 rearward to open the ink cartridge 6. At that time, the outer peripheral surface of the projection 53, with the exception of the grooves 54, is in a condition of approximately fitting the inner circumferential surface of the opening 72. In addition, the outer peripheral surface of the opening 72 is air tight fitted in the inner circumferential surface of the air tight connecting portion 52. Thus, the ink cartridge 6 is connected to the writing instrument body.

When the ink cartridge 6 is connected with the writing instrument body, the circular space inside the opening 72 is divided by the projection 53 and separated into two channels constructed of the grooves 54. Therefore, when the ink is supplied from inside the ink cartridge 6 through the ink guiding portions 51 to the pen point 3 side (that is, when it is being used to write), one of the grooves 54 serves as an ink channel and the other groove 54 serves as an air intake path from the pen point 3 side into the ink cartridge 6. With such a configuration, the space to be the air intake path does not become clogged (in a fluid tight condition) by the ink, and the internal pressure in the ink storage portion 71 of the container 7 becomes always constant. As a result, the ink supply to the pen point 3 is carried out always stably and it is possible to write stably without causing scratchy handwriting and the like.

Figure 6:
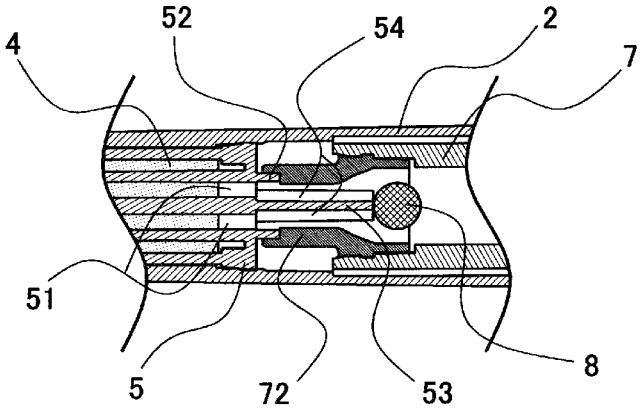
FIG. 6 is a cross-sectional view illustrating major portions of a second embodiment of the writing instrument according to the first aspect of the present invention.
Figure 7:
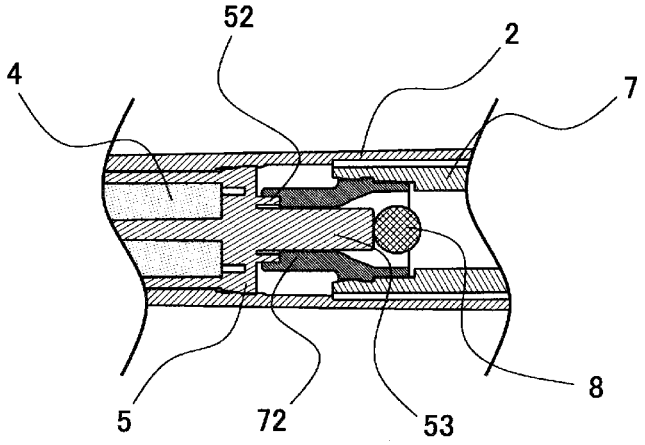
FIG. 7 is a cross-sectional view of the writing instrument in FIG. 6 on a cross section 90° rotated.

FIGS. 6 and 7 illustrate major portions of a writing instrument 1 of the second embodiment. FIG. 6 is a cross-sectional view corresponding to FIG. 1 of the first embodiment. FIG. 7 is a cross-sectional view corresponding to FIG. 4. The writing instrument 1 of the present embodiment differs from the first embodiment in the configuration of the air tight connecting portion 52 in the rear of the intermediate member 5 and the front end of the opening 72 of the ink cartridge 6 that are illustrated in FIGS. 6 and 7. The rest of the configuration is same as the first embodiment.

The intermediate member 5 is a member obtained by injection molding of a synthetic resin. The intermediate member 5 is provided with a partition wall that divides the ink absorber 4 from the ink cartridge 6. In the front surface of the partition wall, two communication pipes that project forward and hit inside the ink absorber 4 are formed. The communication pipes are provided axially with an ink guiding portions 51. On the rear surface of the partition wall, a projection 53 that projects rearward and is inserted into the opening 72 of the ink cartridge 6 is formed. Further, on the rear surface of the partition wall, an air tight connecting portion 52 of a short length that projects rearward and is located on the outer periphery of the projection 53 is formed. The intermediate member 5 is constructed as a single member provided with the partition wall, the communication pipes, the projection 53, and the air tight connecting portion 52.

The air tight connecting portion 52 of the present embodiment illustrated in FIGS. 6 and 7 is in a cylindrical shape having an extremely short length in comparison with the air tight connecting portion 52 of the first embodiment illustrated in FIGS. 1 and 4. In the writing instrument 1 of the present embodiment illustrated in FIGS. 6 and 7, by fitting the outer peripheral surface of the air tight connecting portion 52 in the inner circumferential surface near the front end of the opening 72, the inner circumferential surface of the opening 72 of the ink cartridge 6 is connected and retained in an air tight condition.

The projection 53 illustrated in FIGS. 6 and 7 is inserted into the opening 72 of the ink cartridge 6 to be in an approximately fitting condition. The grooves 54 have two through holes in communication with the ink guiding portions 51 formed in the end portion on the partition wall side. When the projection 53 fits the opening 72 of the ink cartridge 6, the plug 8 is in an opened condition. At this time, one of the two grooves 54 serves as an ink channel. The ink channel becomes a path to supply the ink in the ink cartridge 6 to the pen point 3 side. The other of the two grooves 54 serves as an air intake path. The air intake path becomes a path that lets the air flow into the ink cartridge 6 from the pen point 3 side. With such a configuration, the internal pressure balance between the writing instrument body and the ink cartridge 6 is maintained.

By providing the two grooves 54 to be the ink channel and the air intake path in the outer surface of the projection 53, the opening 72 of the ink cartridge 6 is divided radially into a plurality of openings (in the present embodiment, two). Thus, the ink channel and the air intake path are formed respectively independently without making contact with each other.

In the writing instrument 1 illustrated in FIGS. 6 and 7, the ink cartridge 6 is inserted from the rear end opened area of the barrel 2, and further, pressed forward. Thus, the rear end of the projection 53 presses the plug 8 rearward to open the ink cartridge 6. At that time, the outer peripheral surface of the projection 53, with the exception of the grooves 54, and the inner circumferential surface of the opening 72 are in an approximately fitting condition. In addition, the inner circumferential surface at the front of the opening 72 is air tight fitted in the outer peripheral surface of the air tight connecting portion 52. Thus, even when the projection 53 loosely fits inside the opening 72, it is possible to inhibit ink leakage of the ink cartridge 6 in a connected condition and also possible to retain a firmer connected condition.

Figure 8:
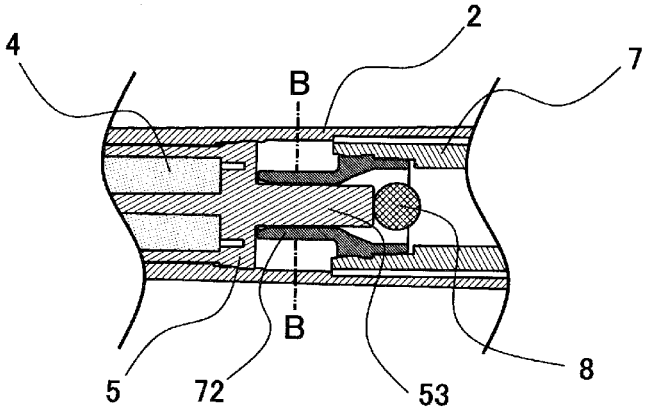
FIG. 8 is a cross-sectional view illustrating major portions of a third embodiment of the writing instrument according to the first aspect of the present invention.
Figure 9:
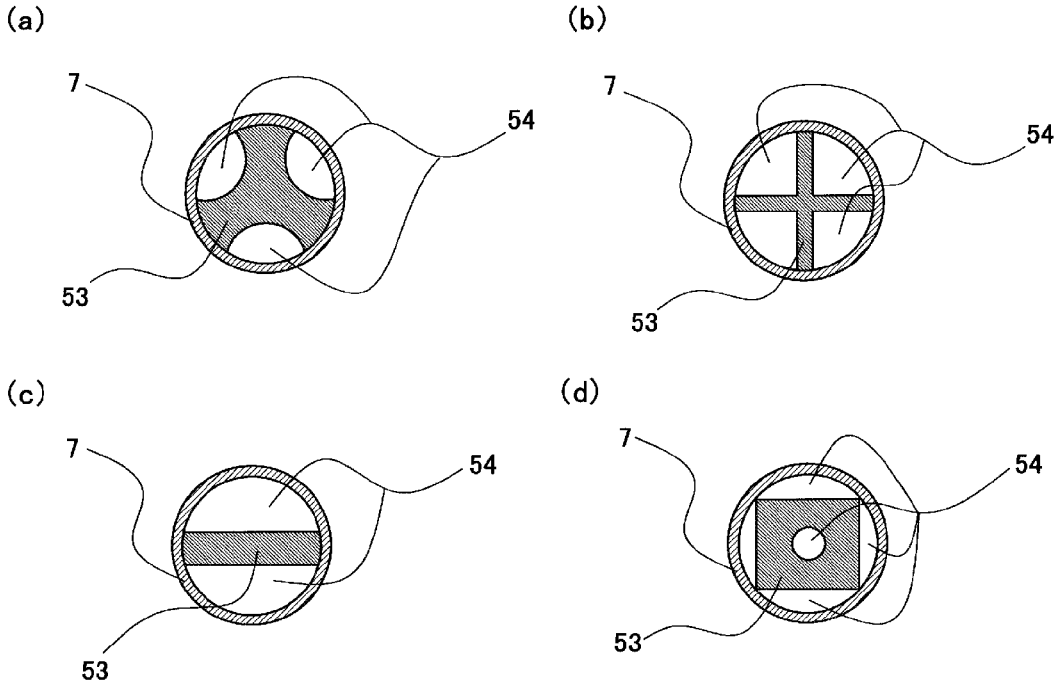
FIG. 9 are B-B cross-sectional views illustrating a connecting area of the writing instrument in FIG. 8, where the figures (a) through (d) illustrate a plurality of embodiments of projection shape.

Next, FIGS. 9(*a*) through (*d*) illustrate, as another embodiment, four specific examples different in the shape of the projection 53. FIGS. 9(*a*) through (*d*) are B-B cross sections in the connecting area of the ink cartridge 6 illustrated in FIG. 8. FIG. 8 is a cross-sectional view corresponding to FIG. 4 of the first embodiment. The writing instrument 1 of the present embodiment differs from the first embodiment in the shape of the projection 53 of the intermediate member 5 and in the shape of the opening 72 of the ink cartridge 6 that are illustrated in FIGS. 8, 9. The rest of the configuration is same as the first embodiment.

The intermediate member 5 is obtained by injection molding of a synthetic resin. The intermediate member 5 has a partition wall that divides the ink absorber 4 from the ink cartridge 6. On the front surface of the partition wall, a plurality of communication pipes are formed that projects forward and hit inside the ink absorber 4. The communication pipes are provided axially with ink guiding portions 51. On the rear surface of the partition wall, a projection 53 is formed that projects rearward and is inserted into the opening 72 of the ink cartridge 6. The intermediate member 5 is constructed as a single member provided with the partition wall, the communication pipes, and the projection 53.

In the writing instrument 1 of the present embodiment, the projection 53 is engaged in the opening 72 of the ink cartridge 6. By fitting the outer peripheral surface of the projection 53 in the inner circumferential surface of the opening 72, the inner circumferential surface of the ink cartridge 6 is connected and retained. In addition, by connecting the front end of the opening 72 of the ink cartridge 6 in a position to make contact with the partition wall, an air tight condition is formed to have a structure of not easily causing ink leakage.

All of the projections 53 illustrated in FIGS. 9(*a*) through (*d*) are columnar objects having an outer diameter to fit the opening 72 of the ink cartridge 6.

The projection 53 illustrated in FIG. 9(*a*) has a cross section in an approximate Y shape. The approximately Y shaped projection 53 has three longitudinally extending semicircular grooves 54. The three semicircular grooves 54 are formed in circumferentially equal positions of the projection 53. The grooves 54 have a through hole in communication with the ink guiding portions 51 formed on the partition wall side.

The projection 53 illustrated in FIG. 9(*b*) has a cross section in an approximate X shape. The approximately X shaped projection 53 divides the inside of the opening 72 of the ink cartridge 6 into four longitudinally extending channels (grooves 54). The grooves 54 have a through hole in communication with the ink guiding portions 51 formed in the partition wall side.

When the projection 53 illustrated in FIG. 9(*a*) or (*b*) fits the opening 72 of the ink cartridge 6, the plug 8 is in an opened condition. At this time, any of the plurality of grooves 54 may serve as an ink channel. The ink channel becomes a path to supply the ink in the ink cartridge 6 to the pen point 3 side. On the other hand, the rest of the grooves 54, which do not serve as ink channels, serve as air intake paths. The air intake paths become paths to let the air flow into the ink cartridge 6 from the pen point 3 side. With such a configuration, the internal pressure balance between the writing instrument body and the ink cartridge 6 is maintained.

By providing the projection 53 with a cross sectional shape of an approximate Y shape or an approximate X shape, the opening 72 of the ink cartridge 6 is divided radially into a plurality of openings. Thus, the ink channel and the air intake paths are formed respectively independently without making contact with each other.

The projection 53 illustrated in FIG. 9(*c*) has a cross section in an approximately rectangular shape. The approximately rectangular shaped projection 53 has side face portions to fit the opening 72 formed with roundness.

The projection 53 illustrated in FIG. 9(*d*) has a cross section in a square shape. In the axial center portion of the square projection 53, a through hole (groove 54), to serve as an ink channel or an air intake path, is formed.

When the projection 53 illustrated in FIG. 9(*c*) or (*d*) fits the opening 72 of the ink cartridge 6, the plug 8 is in an opened condition. At this time, the projection 53 divides the inside of the opening 72, thereby forming a plurality of channels (grooves 54) between the inner circumferential surface of the opening 72 and the outer peripheral surface of the projection 53. Any of the plurality of grooves 54 acts as an ink channel. The ink channel serves as a path to supply the ink in the ink cartridge 6 to the pen point 3 side. On the other hand, the rest of the grooves 54, which do not serve as ink channels, serve as air intake paths. The air intake paths become paths to let the air flow into the ink cartridge 6 from the pen point 3 side. With such a configuration, the internal pressure balance between the writing instrument body and the ink cartridge 6 is maintained.

By providing the projection 53 with the cross sectional shape of an approximately rectangular shape or a square shape, the opening 72 of the ink cartridge 6 is divided radially into plurality. Thus, the ink channel and the air intake paths are formed respectively and independently without making contact with each other.

The writing instrument 1 illustrated in FIGS. 8 and 9(*a*) through (*d*) has the structure where a part of the outer peripheral surface of the projection 53 fits the inner circumferential surface of the opening 72. Thus, the connected condition of the ink cartridge 6 is retained firmer. In addition, the writing instrument 1 illustrated in FIGS. 8 and 9(*a*) through (*d*) has the structure where the front end of the opening 72 makes tight contact with the surface of the partition wall of the intermediate member 55. Thus, an air tight condition of the ink cartridge 6 is formed and ink leakage in a connected condition of the ink cartridge 6 is inhibited.

<Embodiments According to Second Aspect of the Invention>

Next, embodiments of a writing instrument and an ink cartridge according to a second aspect of the present invention will be described with reference to the drawings. It should be noted that the second aspect of the present invention is not limited to embodiments described below.

Figure 10:
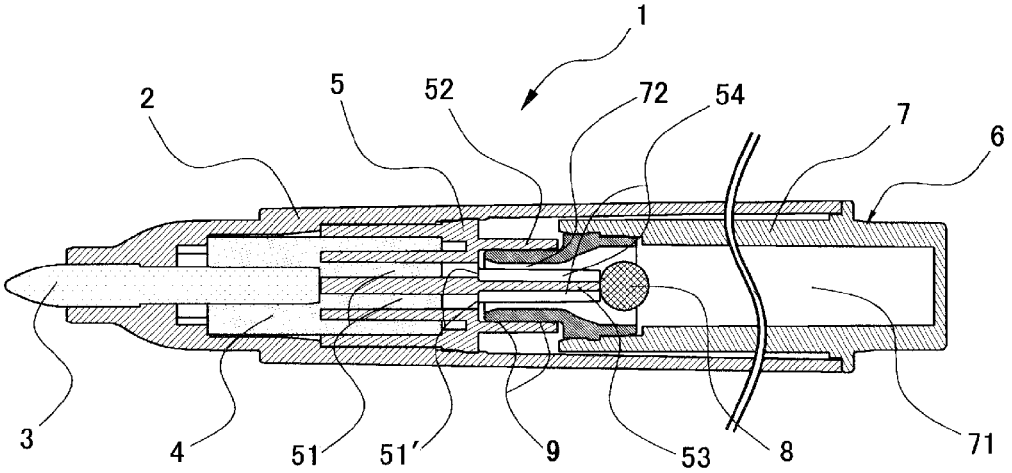
FIG. 10 is a cross-sectional view (axially foreshortened view) illustrating one embodiment of a writing instrument according to a second aspect of the present invention.

A writing instrument 1 of the embodiment illustrated in FIG. 10 is configured with, same as the first embodiment illustrated in FIG. 1, a writing instrument body and an ink cartridge 6. The writing instrument body has a configuration in which a pen point 3 to be a writing tip end is provided at the front end of a barrel 2 and an ink absorber 4 and an intermediate member 5 are arranged in the barrel 2. The ink cartridge 6 has a configuration in which ink is directly stored in a bottomed cylindrical container 7 that has an opening 72 blocked by a plug 8.

Figure 11:
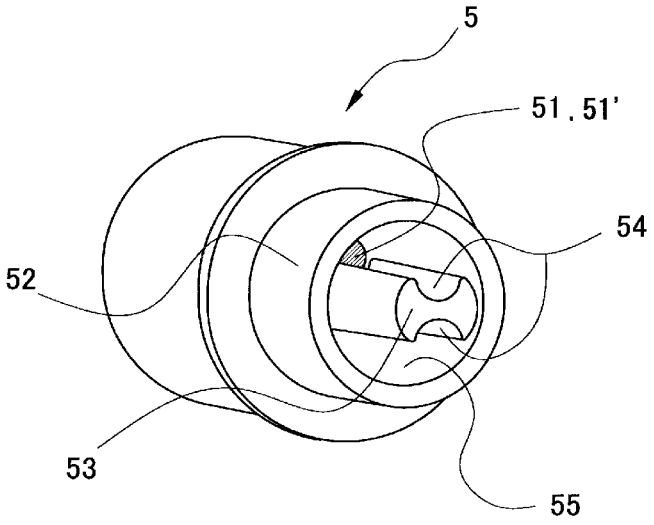
FIG. 11 is an enlarged perspective view of an intermediate member to be used for the writing instrument in FIG. 10.

The writing instrument 1 is a direct fluid type writing instrument. The barrel 2 of the writing instrument body is provided with the pen point 3, the ink absorber 4 connected to the rear end of the pen point 3, and the intermediate member 5 disposed behind the ink absorber 4. As illustrated in FIGS. 10 and 11, the intermediate member 5 is provided with an air tight connecting portion 52 and a projection 53 in the rear. The barrel 2 has a configuration in which the pen point 3 is retained at the front end and also the ink absorber 4 and the intermediate member 5 are built in. Further, the writing instrument body and the ink cartridge 6 make the form of a writing instrument by fitting the ink cartridge 6, inserted into the rear end opened area of the barrel 2, in the air tight connecting portion 52 of the intermediate member 5.

The pen point 3 is a rod-like marking pen tip obtained by resin treatment of synthetic resin fiber (for example, polyester fiber, acrylic fiber, nylon fiber, and the like). While the front end of the pen point 3 is ground in a bullet shape, it is possible to apply those processed in a general purpose shape, such as a chisel shape. Further, as the pen point 3, it is also possible to use a ballpoint pen tip and the like as well as the marking pen tip.

The ink absorber 4 is made with a columnar processed object of synthetic resin fiber (for example, polyester fiber). The outer peripheral surface of the ink absorber 4 is coated with a cylindrical outer skin. The outer skin is made from a film of a synthetic resin or non-woven fabric. For example, as the outer skin, the present embodiment uses a film of polyethylene terephthalate. Hitting the axial center on the front end surface of the ink absorber 4, the rear end of the pen point 3 is located at the inside front of the ink absorber 4.

As the ink absorber 4, it is possible to use those for general purpose as long as they have a structure that is capable of retaining the ink temporarily. As the ink absorber 4, it is also possible to use an accordion-like ink holding member (pen core) and the like.

The barrel 2 is a tubular object obtained by injection molding of a synthetic resin (for example, polypropylene, polyethylene, and the like). The front end of the barrel 2 retaining the outer peripheral surface of the pen point 3 is tapered. The barrel 2 is molded as a single member from the front end to the opening area in the rear end. Further, the ink absorber 4 and the intermediate member 5 are arranged inside the barrel 2. When the ink cartridge 6 is connected to the writing instrument body, the ink cartridge 6 in a connected conditions arranged inside the barrel 2.

As a specific structure, in the inner surface of the barrel 2, a plurality of longitudinally extending ribs are formed integrally. Press fitted to the outer peripheral surface of the ink absorber 4, the ribs retain the ink absorber 4. The barrel 2 also has ribs formed in the inner surface of the tapered portion. Press fitted to the outer peripheral surface of the pen point 3, the ribs retain the pen point 3.

The ribs form respective air paths between the outer peripheral surface of the ink absorber 4 and the inner surface of the barrel 2 and between the outer peripheral surface of the pen point 3 and the inner surface of the tapered portion.

As illustrated in FIGS. 10 and 11, the intermediate member 5 is obtained by injection molding of a synthetic resin (for example, polypropylene, polyethylene, and the like). The intermediate member 5 has an approximately disk-shaped partition wall that separates the ink absorber 4 from the ink cartridge 6. The partition wall is provided with two through holes 51'. On the front surface of the partition wall, a plurality (for example, two) of communication pipes that project forward and hit inside the ink absorber 4 are formed. The communication pipes are provided with ink guiding portions 51 that extend axially from the through holes 51'. On the rear surface of the partition wall, the projection 53, which projects rearward and is inserted into the opening 72 of the ink cartridge 6, is formed. Further, on the rear surface of the partition wall, the cylindrical air tight connecting portion 52, which projects rearward and is formed to have the projection 53 located at the axial center, is formed. The through holes 51' of the partition wall are disposed inside the air tight connecting portion 52. The intermediate member 5 is constructed in one member provided with the partition wall, the communication pipes, the projection 53, and the air tight connecting portion 52. By fitting the outer peripheral surface of the partition wall in the inner circumferential surface of the barrel 2, the intermediate member 5 is fixed.

Inside the cylindrical air tight connecting portion 52, two channels in communication with the two through holes 51' are formed. By being in communication with the respective ink guiding portions 51, these channels serve as an ink channel and an air intake path. In addition, the inner circumferential surface of the cylindrical air tight connecting portion 52 becomes an air tight portion 9 that air tight fits the outer peripheral surface of the opening 72 of the ink cartridge 6.

In the writing instrument 1 of the present embodiment, two annular ribs are formed on the outer peripheral surface near the opening 72 of the ink cartridge 6. By press fitting the annular ribs to the inner circumferential surface of an air tight connecting portion 52 with an appropriate fitting force, the outer peripheral surface of the opening 72 of the ink cartridge 6 is connected and retained in an air tight condition. However, the writing instrument of the present invention is not limited to this configuration. For example, it is also possible to have a configuration in which the inner circumferential surface of the air tight connecting portion 52 fits with the outer peripheral surface of the opening 72 by surface contact without providing the annular ribs.

More detailed descriptions are given to a configuration of the intermediate member 5 by the cross-sectional view in FIG. 10 and the perspective view in FIG. 11.

As illustrated in FIG. 11, in the projection 53 of the intermediate member 5, longitudinally extending semicircular grooves (channels) 54 are formed. In the present embodiment, the two grooves 54 are formed at vertically symmetrical positions in the projection 53. As illustrated in FIG. 10, when the projection 53 is inserted into the opening 72 of the ink cartridge 6, the outer peripheral surface of the projection 53, with the exception of the grooves 54, is in a condition of loose fitting to the inner circumferential surface of the opening 72. The grooves 54 have the through holes 51' in communication with the ink guiding portions 51 formed in the end portion on the partition wall side. When the projection 53 fits the opening 72 of the ink cartridge 6, the plug 8 described later is opened. At this time, one of the two grooves 54 acts as an ink channel. The ink channel becomes a path to supply the ink in the ink cartridge 6 to the pen point 3 side. In addition, the other of the two grooves 54 serves as an air intake path. The air intake path becomes a path to let the air flow into the ink cartridge 6 from the pen point 3 side. With such a configuration, the internal pressure balance between the writing instrument body and the ink cartridge 6 is maintained.

The loose fitting condition of the opening 72 and the projection 53 described above is a condition where a minute gap to the extent that the ink does not penetrate between the inner circumferential surface of the opening 72 and the outer peripheral surface of the projection 53 is formed.

By providing the two grooves 54 to be the ink channel and the air intake path in the outer peripheral surface of the projection 53, the opening 72 of the ink cartridge 6 is divided radially into a plurality of openings (in the present embodiment, two). Thus, the ink channel and the air intake path are formed respectively independently without making contact with each other.

The insertion condition of the outer peripheral surface of the projection 53 and the inner circumferential surface of the opening 72 is not limited to the loose fitting condition. For example, as the approximately fitting condition described above, it may also be in a condition where the outer peripheral surface of the projection 53 and the inner circumferential surface of the opening 72 make tight contact on the entire surface or partially.

As illustrated in FIG. 10, the ink cartridge 6 is provided with the container 7, which is a bottomed cylindrical object with an opened front end and a closed rear end, and the opening 72 fitted in the opened area of the container 7. The container 7 is obtained by injection molding or blow molding of a synthetic resin (for example, a polypropylene resin). The plug 8 is fitted into the inner wall of the opening 72, and the two annular ribs are formed in the outer peripheral surface of the opening 72. In addition, the interior of the container 7 is an ink storage portion 71. In the ink storage portion 71, oil-based ink, for example, is directly stored (the ink is not shown). In the present embodiment, in order to tightly seal the inner circumferential surface of the opening 72 by the spherical plug 8, the opening 72 as a separate member is fitted in the opened area of the container 7. When the ink cartridge 6 is connected to the writing instrument body, the outer peripheral surface in the rear of the container 7 is fitted in the inner surface of the rear end of the barrel 2. The rear end of the container 7 is formed to be an end plug of the writing instrument 1. While the present embodiment has a configuration in which the outer peripheral surface in the rear of the container 7 fits the barrel 2 to connect the ink cartridge 6 to the writing instrument body, the writing instrument of the present invention is not limited to this configuration. For example, it is also possible to apply a connection method where the ink cartridge 6 less likely to come off, such as screwing the container 7 together with the barrel 2. In addition, while a spherical object is used as the plug 8 in the present embodiment, the writing instrument of the present invention is not limited to this configuration. The plug 8 may also be a conventionally known form, such as a disk shape and a thin wall shape molded integrally with the opening 72, for example, as long as it is capable of being press-opened.

As the oil-based ink, oil-based ink for writing board is applied that uses, for example, ethanol and isopropyl alcohol as a solvent and contains an additive, such as pigment, a resin, and a remover. Oil-based ink for writing board of such composition is excellent in drying properties and erasability of handwriting when being written. The ink applied to the second aspect of the present invention is not limited to the composition of the oil-based ink for writing board and may be oil-based ink not containing a remover or water-based ink containing water as a main solvent.

The ink cartridge 6 is inserted into the rear end opened area of the barrel 2 constituting the writing instrument body, and further, pressed forward. Thus, the rear end of the projection 53 presses the plug 8 rearward to open the ink cartridge 6. At that time, the outer peripheral surface of the projection 53 except the grooves 54 and the inner circumferential surface of the opening 72 are in a loose fitting condition. In addition, the annular ribs in the outer peripheral surface of the opening 72 are air tight fitted in the inner circumferential surface of the air tight connecting portion 52. Thus, the air tight portion 9 is formed between the outer peripheral surface of the opening 72 and the air tight connecting portion 52, and the ink cartridge 6 is connected to the writing instrument body. With such a configuration, an appropriate fitting force is applied to the inner circumferential surface of the air tight connecting portion 52 and the outer peripheral surface of the opening 72. As a result, it is possible to install (connect) the ink cartridge 6 with a small force and the ink cartridge 6 does not easily fall.

In addition, in such connected condition of the ink cartridge 6 and the writing instrument body, the circular space inside the opening 72 is divided by the projection 53 and separated into two channels constructed of the grooves 54. Therefore, the ink in the ink cartridge 6 is supplied to the pen point 3 side through the through holes 51' and the ink guiding portions 51. When the ink is supplied to the pen point 3 side (that is, when it being used to write), one of the grooves 54 serves as an ink channel and the other groove 54 serves as an air intake path from the pen point 3 side into the ink cartridge 6. With such a configuration, the space to be the air intake path does not become clogged (in a fluid tight condition) by the ink, and the internal pressure in the ink storage portion 71 of the container 7 becomes always constant. As a result, ink supply to the pen point 3 is carried out always stably and it is possible to write stably without causing scratchy handwriting and the like.

In the writing instrument 1 of the present embodiment, the ink cartridge 6 is connected to the writing instrument body with an appropriate fitting force. Thus, when the ink cartridge 6 is replaced after ink consumption, a user can remove the empty ink cartridge 6 without requiring a large force. In particular, by air tight fitting the outer peripheral surface of the ink cartridge 6 in the inner circumferential surface of the air tight connecting portion 52 via the annular ribs, adjustment of the fitting force is facilitated not depending on an error in forming dimensions. In addition, by providing the two annular ribs, shaking of the ink cartridge 6 in a connected condition is inhibited. Accordingly, the writing instrument 1 of the present embodiment has an excellent configuration particularly in easy replacement of the ink cartridge 6.

In addition, the connection structure of the embodiment of the second aspect of the present invention described above exhibits a particularly useful effect when applied to a writing instrument with a narrow barrel that has the opening 72 of the ink cartridge 6 with an inner diameter of 17 mm or less, preferably 10 mm or less (more specifically, from 4 mm to 10 mm). When the inner diameter of the opening 72 of the ink cartridge 6 is large, constant channels are also easily secured with a configuration in which another member fits the inner circumferential surface of the opening 72. In contrast, when the inner diameter of the opening 72 of the ink cartridge 6 is small, for example in a case of 17 mm or less, it is difficult to secure channels with the configuration in which another member fits the inner circumferential surface of the opening 72. Therefore, the outflow of the ink to the pen point 3 side and inflow of the air to inside the ink cartridge 6 may be more easily impeded. On the other hand, because the connection structure of the embodiment of the second aspect of the present invention described above has a configuration in which the outer peripheral surface of the opening 72 of the ink cartridge 6 air tight fits the inner circumferential surface of the air tight connecting portion 52 of the writing instrument body, it is possible to secure the ink channel and the air intake path inside the opening 72. As a result, outflow of the ink to the pen point 3 side and intake of the air to inside the ink cartridge 6 are not impeded. Thus, ink supply to the pen point 3 is carried out always stably and it is possible to write stably without causing scratchy handwriting and the like.

Figure 12:
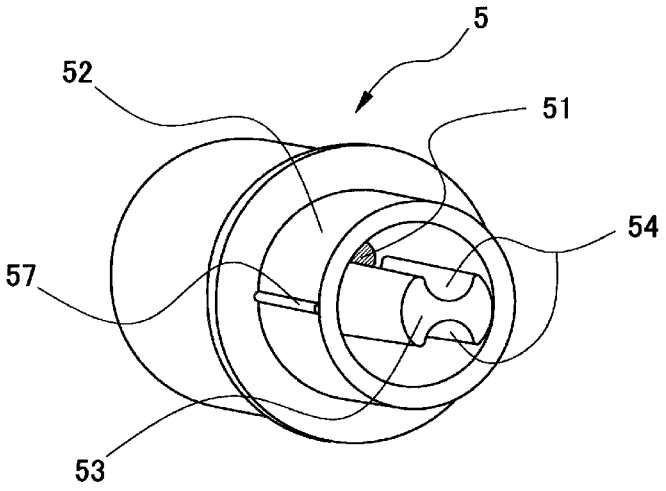
FIG. 12 is an enlarged perspective view of an intermediate member of another embodiment in the writing instrument according to the second aspect of the present invention.
Figure 13:
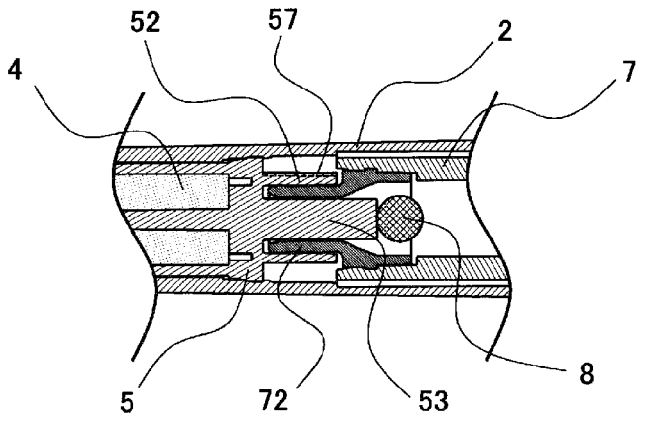
FIG. 13 is a cross-sectional view illustrating major portions of a connecting area of the writing instrument in which the intermediate member in FIG. 12 is used.

Here, FIGS. 12 and 13 illustrate another embodiment of the intermediate member 5 constituting the writing instrument 1 of the present embodiment. The intermediate member 5 is not limited to the configuration illustrated in FIG. 10 and FIG. 11. For example, as illustrated in FIGS. 12 and 13, the intermediate member 5 may also have configurations in which one or a plurality of convex threads 57 formed on the outer peripheral surface of the air tight connecting portion 52.

The convex threads 57 prevent the inner circumferential surface of the opening 72 of the ink cartridge 6 from fitting the outer peripheral surface of the air tight connecting portion 52. As described above, in the connection structure of the present embodiment, the inner circumferential surface of the opening 72 of the ink cartridge 6 air tight fits the outer peripheral surface of the air tight connecting portion 52. However, if the inner diameter of the opening 72 of the ink cartridge 6 is approximately equals to the outer diameter of the air tight connecting portion 52, it is possible to fit the inner circumferential surface of the opening 72 in the outer peripheral surface of the air tight connecting portion 52. In such case, the connection structure of the second aspect of the present invention is not performed. Then, by forming the convex threads 57 as illustrated in FIGS. 12, 13 on the outer peripheral surface of the air tight connecting portion 52, it is possible to prevent fitting of the ink cartridge 6 having the opening 72 with an inner diameter larger than the outer diameter of the air tight connecting portion 52.

<Embodiments According to Third Aspect of the Invention>

Next, embodiments of a writing instrument and an ink cartridge according to a third aspect of the present invention will be described with reference to the drawings. It should be noted that the third aspect of the present invention is not limited to embodiments described below.

Figure 14:
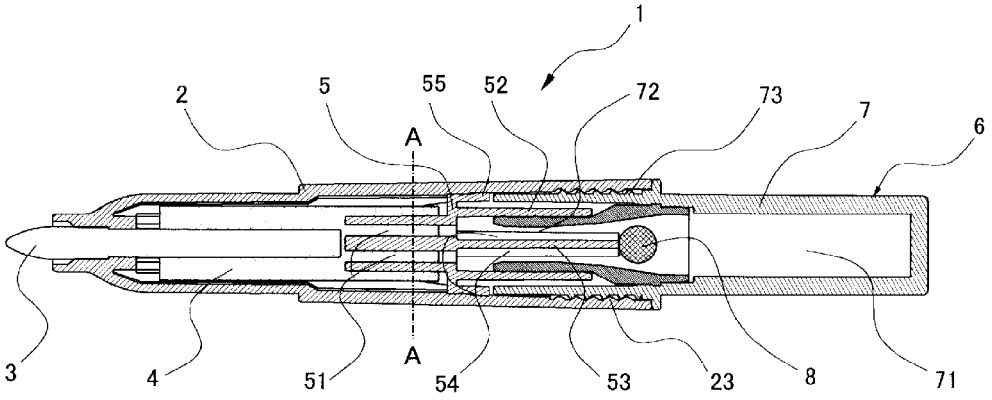
FIG. 14 is a cross-sectional view illustrating one embodiment of a writing instrument according to a third aspect of the present invention.

A writing instrument 1 of the embodiment illustrated in FIG. 14 is configured with a writing instrument body and an ink cartridge 6. The writing instrument body has a configuration in which a pen point 3 to be a writing tip end is provided at the front end of a barrel 2 and an ink absorber 4 and an intermediate member 5 are arranged in the barrel 2. The ink cartridge 6 has a configuration in which ink is directly stored in a bottomed cylindrical container 7 that has an opening 72 blocked by a plug 8. The writing instrument 1 of the present embodiment is a capped writing instrument with a cap installed in the front side of the barrel 2 (the cap is not shown).

Figure 17:
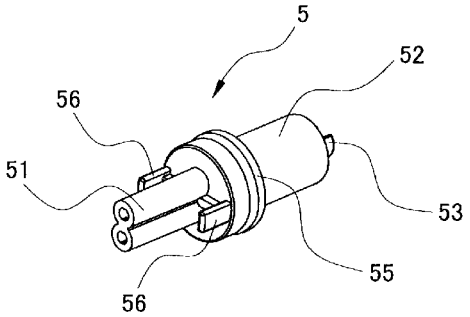
FIG. 17 is a perspective view of an intermediate member to be used for the writing instrument in FIG. 14.

The writing instrument 1 is a direct fluid type writing instrument. The barrel 2 of the writing instrument body is provided with the pen point 3, the ink absorber 4 connected to the rear end of the pen point 3, and the intermediate member 5 disposed in the rear of the ink absorber 4. As illustrated in FIGS. 14, 17, the intermediate member 5 has an approximately disk-shaped partition wall with a fitting portion 55 formed therewith. The intermediate member 5 is provided with an air tight connecting portion 52 and a projection 53 in the rear of the partition wall. The barrel 2 is a cylindrical resin molding having an open rear end. The barrel 2 has a configuration in which the pen point 3 is retained at the front end and also the ink absorber 4 and the intermediate member 5 are built in. Further, the writing instrument body and the ink cartridge 6 make the form of a writing instrument by screwing the ink cartridge 6 inserted into the rear end opened area of the barrel 2 together with the barrel 2 and also fitting in the air tight connecting portion 52.

The pen point 3 is a rod-like marking pen tip obtained by resin treatment of synthetic resin fiber (for example, polyester fiber, acrylic fiber, nylon fiber, and the like). While the front end of the pen point 3 is ground in a bullet shape, it is possible to apply those processed in a general purpose shape, such as a chisel shape. Further, as the pen point 3, it is also possible to use a ballpoint pen tip and the like as well as the marking pen tip.

The ink absorber 4 is made with a columnar object of synthetic resin fiber (for example, polyester fiber). The outer peripheral surface of the ink absorber 4 is coated with a cylindrical outer skin. The outer skin is made from a film of a synthetic resin (for example, a film of polyethylene terephthalate). Hitting the axial center on the front end surface of the ink absorber 4, the rear end of the pen point 3 is located at the inside front of the ink absorber 4.

As the ink absorber 4, it is possible to use those for general purpose as long as they have a structure that is capable of retaining the ink temporarily. As the ink absorber 4, it is also possible to use an accordion-like ink holding member (pen core) and the like.

Figure 16:
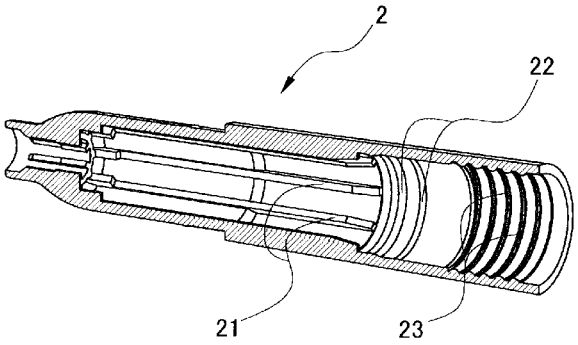
FIG. 16 is a cross-sectional perspective view of a barrel to be used for the writing instrument in FIG. 14.

As illustrated in FIGS. 14 and 16, the barrel 2 is a tubular object obtained by injection molding of a synthetic resin (for example, polypropylene, polyethylene, and the like). The front end of the barrel 2, which retains the outer peripheral surface of the pen point 3, is tapered. The barrel 2 is molded in one member from the front end to the opening area in the rear end. Further, inside the barrel 2, the ink absorber 4 and the intermediate member 5 are arranged. At the rear of the barrel 2, screw threads 23 (internal threads), which screw the ink cartridge 6 together, are formed. In addition, in a position to arrange the intermediate member 5 of the barrel 2, two annular ribs 22 are formed. The annular ribs 22 fit the fitting portion 55 of the intermediate member 5 and retain the intermediate member 5 at a specified position.

As a specific structure, on the inner surface of the barrel 2, a plurality of longitudinally extending restricting ribs 21 are formed at regular intervals. The restricting ribs 21 press fit and retain the outer peripheral surface of the ink absorber 4. The restricting ribs 21 also act as locked portions for the locking portions 56 illustrated in FIGS. 15, 17. The restricting ribs 21 are molded at regular intervals integrally on the inner surface of the barrel 2. When a strong rotary force is applied to the intermediate member 5, such restricting ribs 21 securely make contact with and lock the locking portions 56. Thus, rotation of the intermediate member 5 is inhibited. The number of the restricting ribs 21 is not particularly limited. For example, in the embodiment illustrated in FIG. 15, eight restricting ribs 21 are formed. In addition, in the embodiment illustrated in FIG. 19, twenty restricting ribs 21 are formed.

Further, other retaining ribs are formed in the inner surface of the tapered portion of the barrel 2. The retaining ribs press fit and retain the outer peripheral surface of the pen point 3.

The restricting ribs 21 and the retaining ribs form respective air paths between the outer peripheral surface of the ink absorber 4 and the inner surface of the barrel 2 and between the outer peripheral surface of the pen point 3 and the inner surface of the tapered portion.

As illustrated in FIG. 17, the intermediate member 5 is obtained by injection molding of a synthetic resin (for example, polypropylene, polyethylene, and the like). The approximately disk-shaped partition wall constituting the intermediate member 5 separates the ink absorber 4 from the ink cartridge 6. In the front surface of the partition wall, a plurality (for example, two) of communication pipes are formed that project forward and hit inside the ink absorber 4. The communication pipes are provided axially with ink guiding portions 51. On the rear surface of the partition wall, a projection 53 is formed that projects rearward and is inserted into the opening 72 of the ink cartridge 6. Further, on the rear surface of the partition wall, the tubular air tight connecting portion 52 that projects rearward and is formed to have the projection 53 located at the axial center. As already described, the fitting portion 55 is formed on the outer peripheral surface of the partition wall, and the locking portions 56 are formed on the front surface of the partition wall. The fitting portion 55 is an annular stepped portion and fitted to the two annular ribs 22 formed in the inner surface of the barrel 2 for fixation. The two locking portions 56 stick out forward. As described above, the intermediate member 5 is constructed in one member provided with the partition wall, the fitting portion 55, the communication pipes, the locking portions 56, the projection 53, and the air tight connecting portion 52.

In the writing instrument 1 of the present embodiment, annular ribs are formed in the outer peripheral surface near the opening 72 of the ink cartridge 6. By press fitting the annular ribs to the inner circumferential surface of the air tight connecting portion 52, the outer peripheral surface of the opening 72 of the ink cartridge 6 is connected and retained in an air tight condition. However, the writing instrument of the present invention is not limited to this configuration. For example, it may also adopt a configuration in which the inner circumferential surface of the air tight connecting portion 52 fits the outer peripheral surface of the opening 72 by surface contact, without providing the annular ribs. It is also possible to use other structures that do not cause ink leakage, such as a structure forming an air tight condition by fitting the outer peripheral surface of the projection 53 in the inner circumferential surface of the opening 72 of the ink cartridge 6 (refer to FIGS. 6, 7) and a structure forming an air tight condition by press fitting the front surface of the opening 72 of the ink cartridge 6 to the partition wall of the intermediate member 5.

In particular, when the air tight connecting portion is configured to guide the ink into the tube, by press fitting and connecting the outer peripheral surface of the air tight connecting portion to the inner circumferential surface of the ink cartridge, it is possible to easily form an air tight condition of them. Consequently, the third aspect of the present invention is particularly easy to be applied to the form where the outer peripheral surface of the air tight connecting portion is press fitted and connected to the inner circumferential surface of the ink cartridge.

As illustrated in FIG. 14, in the projection 53, longitudinally extending semicircular grooves (channels) 54 are formed same as the embodiments of the first and the second aspect of the present invention described above. At vertically symmetrical positions in the projection 53, the two grooves 54 are formed. When the projection 53 is inserted into the opening 72 of the ink cartridge 6, the outer peripheral surface of the projection 53, with the exception of the grooves 54, is in a condition of approximately fitting the inner circumferential surface of the opening 72 (preferably, loose fitting condition). In the end portion on the partition wall side of the grooves 54, two through holes in communication with the ink guiding portions 51 are formed. When the projection 53 fits the opening 72 of the ink cartridge 6, the plug 8, described later, is opened. At this time, one of the two grooves 54 acts as an ink channel. The ink channel becomes a path to supply the ink in the ink cartridge 6 to the pen point 3 side. In addition, the other of the two grooves 54 acts as an air intake path. The air intake path becomes a path to let the air flow into the ink cartridge 6 from the pen point 3 side. With such a configuration, the internal pressure balance between the writing instrument body and the ink cartridge 6 is maintained.

By providing the two grooves 54 to be the ink channel and the air intake path in the outer surface of the projection 53, the opening 72 of the ink cartridge 6 is divided radially into plurality (in the present embodiment, two). Thus, the ink channel and the air intake path are formed respectively and independently without making contact with each other.

The approximately fitting condition of the projection 53 and the opening 72 described above includes all of a condition of tight contact on the approximately entire surfaces of the outer surface of the projection 53 and the inner surface of the opening 72, a condition of partial contact, and a condition of forming a minute gap between both surfaces (loose fitting). Therefore, when the projection 53 loosely fits the opening 72, large space channels formed by the two grooves 54 act as the ink channel and the air intake path in a substantially independent condition.

It should be noted that the configuration of letting the projection 53 and the opening 72 in the approximately fitting condition is one of preferred embodiments of the writing instrument of the present invention. The writing instrument of the present invention is not limited to the configuration of letting the projection 53 and the opening 72 in the approximately fitting condition. Consequently, the writing instrument of the present invention includes a configuration of not fitting the projection 53 in the opening 72.

Figure 15:
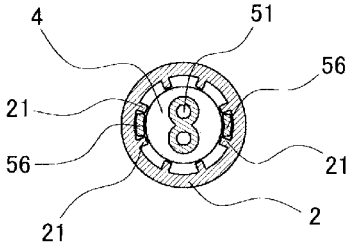
FIG. 15 is an A-A cross-sectional view of the writing instrument in FIG. 14.

As illustrated in FIG. 17, the two locking portions 56 described above are provided in horizontally symmetrical positions to the ink guiding portions 51 (communication pipes) on the front surface of the partition wall of the intermediate member 5. The respective locking portions 56 are both wide ribs and aid in preventing rotation of the intermediate member 5. As illustrated in FIG. 15, the respective locking portions 56 are both capable of being disposed between the two locked portions 21. The width of each locking portion 56 is slightly smaller than the width between the two locked portions 21. Thus, it is possible to easily dispose the respective locking portions 56 between the two locked portions 21 when the fitting portion 55 of the intermediate member 5 is fitted in the annular ribs 22 of the barrel 2, so that work of assembling the intermediate member 5 is facilitated. In addition, when a rotary force is applied to the intermediate member 5 from the ink cartridge 6, the locking portions 56 immediately make contact with the locked portions 21 to restrict rotation of the intermediate member 5.

Figure 18:
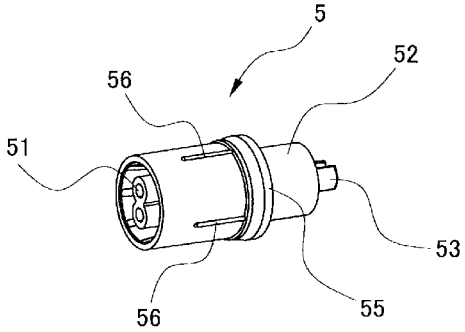
FIG. 18 is a perspective view of an intermediate member of another embodiment in the writing instrument according to the third aspect of the present invention.
Figure 19:
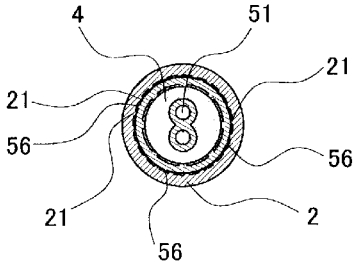
FIG. 19 is a cross-sectional view corresponding to A-A when the intermediate member in FIG. 18 is used for the writing instrument in FIG. 14.

While the present embodiment is described as having the locking portions 56 formed as two independent wide ribs, it is not limited to this configuration. For example, as illustrated in FIGS. 18 and 19, they may also have a structure in which a cylindrical portion surrounding the communication pipes of the ink guiding portions 51 is provided on the front surface of the partition wall of the intermediate member 5 and longitudinal ribs are formed on the outer peripheral surface of the cylindrical portion.

The locking portions 56 may be formed as a single member, or as three or more members. For example, in the embodiment illustrated in FIGS. 18 and 19, four locking portions 56 are formed at regular intervals on the outer peripheral surface of the cylindrical portion. When three or more locking portions 56 are formed, it is preferred that the respective locking portions 56 are disposed radially at regular intervals on the partition wall of the intermediate member 5. However, the intervals between the plurality of locking portions 56 are not limited to regular intervals.

As illustrated in FIG. 14, the ink cartridge 6 is provided with the container 7, which is a bottomed cylindrical object with an opened front end and a closed rear end, and the opening 72 fitted in the opened area of the container 7. On the outer peripheral surface at the front side of the container 7, screw threads 73 (external threads) are formed integrally. The container 7 is obtained by injection molding or blow molding a synthetic resin (for example, a polypropylene resin). The plug 8 is fitted into the inner wall of the opening 72.

In addition, the interior of the container 7 is an ink storage portion 71. In the ink storage portion 71, oil based ink, for example, is directly stored (the ink is not shown). In the present embodiment, in order to tightly seal the inner circumferential surface of the opening 72 by the spherical plug 8, the opening 72 as a separate member is fitted in the opening of the container 7. The ink cartridge 6 is connected to the writing instrument body by screwing the screw threads 73 in the outer peripheral surface of the container 7 together with the screw threads 23 in the inner circumferential surface of the barrel 2. The rear end of the container 7 is formed to be an end plug of the writing instrument 1. While the present embodiment has a configuration in which the screw threads 73 in the outer peripheral surface of the container 7 are screwed together with the screw threads 23 in the inner circumferential surface of the barrel 2 to connect the writing instrument body to the ink cartridge 6, the writing instrument of the present invention is not limited to this configuration. For example, it is also possible to connect the container 7 to the barrel 2 in a method such as fitting. In addition, while a spherical object is used as the plug 8, the writing instrument of the present invention is not limited to this configuration. The plug 8 may also be a conventionally known form, such as a disk shape and a thin wall shape molded integrally with the opening 72, for example, as long as it is capable of being press-opened.

As the oil-based ink, oil-based ink for writing board is applied that uses, for example, ethanol and isopropyl alcohol as a solvent and contains additives, such as pigment, a resin, and a remover. Oil-based ink for writing board of such composition is excellent in drying properties and erasability of handwriting when being written. The ink applied to the third aspect of the present invention is not limited to the composition of the oil-based ink for writing board and may be oil-based ink not containing a remover or water-based ink containing water as a main solvent.

The ink cartridge 6 is rotated in a condition inserted into the rear end opened area of the barrel 2 constituting the writing instrument body. Thus, the screw threads 73 in the outer peripheral surface of the ink cartridge 6 are screwed together with the screw threads 23 in the inner circumferential surface of the barrel 2. At that time, the rear end of the projection 53 presses the plug 8 rearward and the ink cartridge 6 is opened. In addition, the outer peripheral surface of the projection 53 except the grooves 54 and the inner circumferential surface of the opening 72 are in a loose fitting condition. Thus, the outer peripheral surface of the opening 72 is air tight fitted in the inner circumferential surface of the air tight connecting portion 52, and the ink cartridge 6 is connected to the writing instrument body.

In such process of connection between the ink cartridge 6 and the writing instrument body, the ink cartridge 6 is rotated in a condition of fitting the opening 72 in the air tight connecting portion 52, so that a rotary force is applied to the intermediate member 5. According to the writing instrument 1 of the present embodiment, the locking portions 56 make contact with the locked portions 21 to inhibit rotation of the intermediate member 5, so that it is possible to connect the ink cartridge 6 without rotating the intermediate member 5.

In such connected condition of the ink cartridge 6 and the writing instrument body, the circular space inside the opening 72 is divided by the projection 53 and separated into two channels constructed of the grooves 54. Therefore, the ink in the ink cartridge 6 is supplied to the pen point 3 side through the ink guiding portions 51. When the ink is supplied to the pen point 3 side (that is, when it is being used to write), one of the grooves 54 becomes an ink channel and the other groove 54 becomes an air intake path into the ink cartridge 6 from the pen point 3 side. With such a configuration, the space that is the air intake path does not become clogged (in a fluid tight condition) by the ink, and a constant internal pressure is maintained in the ink storage portion 71 of the container 7. As a result, ink supply to the pen point 3 is carried out always stably and it is possible to write stably without causing scratchy handwriting and the like.

Here, to detach the empty ink cartridge 6 in which all the ink is consumed, the ink cartridge 6 is rotated. Thus, the screwing between the screw threads 73 of the ink cartridge 6 and the screw threads 23 of the barrel 2 is released. In addition, in the process of unscrewing the fitting between the air tight connecting portion 52 of the intermediate member 5 and the opening 72 of the ink cartridge 6 is released.

In the process of detaching the ink cartridge 6 as well, the ink cartridge 6 is rotated in a condition of fitting the opening 72 in the air tight connecting portion 52, so that a rotary force is applied to the intermediate member 5. As described above, in the writing instrument 1 of the present embodiment, the intermediate member 5 does not rotate even when the ink cartridge 6 is rotated. That is, the locking portions 56 contacts the locked portions 21 to inhibit rotation of the intermediate member 5. Thus, the intermediate member 5 does not become detached from the barrel 2 together with the empty ink cartridge 6. Consequently, in the writing instrument 1 according to the present embodiment, a component of the writing instrument body does not become lost during replacement of the ink cartridge 6, and it is possible to use the writing instrument body repeatedly.

The writing instrument 1 of the present embodiment has a configuration in which the ink cartridge 6 is screwed together with the barrel 2, so that the ink cartridge 6 is always rotated during installation and removal. However, the third aspect of the present invention exhibits a useful effect even when applied to a writing instrument having a configuration in which the ink cartridge 6 is not screwed together with the barrel 2. That is, the ink cartridge 6 is sometimes installed and removed while being rotated, even in a configuration where the cartridge 6 is not screwed together with the barrel 2 (for example, the configurations illustrated in FIGS. 1, 8, 10), so that in such a case, the third aspect of the present invention exhibits a useful effect of inhibiting rotation of the intermediate member 5.

In addition, the ink cartridge 6 is not limited to the configuration of being screwed together with the barrel 2. For example, a configuration in which the ink cartridge 6 is screwed together with a part of the intermediate member 5, such as the air tight connecting portion 52 and the projection 53, is also contemplated. With such a configuration, the ink cartridge 6 is always rotated during installation and removal, so that the third aspect of the present invention exhibits an effect similar to the present embodiment described above.

Further, the writing instrument 1 of the present embodiment described above has a configuration in which the locking portions 56 are formed in the intermediate member 5 and the locked portions 21 to restrict rotation of the locking portions 56 are formed in the inner circumferential surface of the barrel 2. However, the third aspect of the present invention is not limited to this configuration. For example, it may also have a configuration in which a rotation preventing rib, acting as the locking portion 56, is formed in the inner circumferential surface of the barrel 2 and a plurality of restricting ribs, acting as the locked portions 21, are formed in the outer peripheral surface of the intermediate member 5. Even with such a configuration, the locking portions 56 of the barrel 2 are disposed between the adjacent locked portions 21 of the intermediate member 5 and it is possible to inhibit rotation of the intermediate member 5.

DESCRIPTION OF REFERENCE NUMERALS

1 Writing instrument
2 Barrel
21 Restricting rib (locked portion)
22 Annular rib
23 Screw thread (internal thread)
3 Pen point
4 Ink absorber
5 Intermediate member
51 Ink guiding portion
51' Through hole
52 Air tight connecting portion
53 Projection
54 Channel (groove)
55 Fitting portion
56 Locking portion (rotation preventing rib)
57 Convex thread
6 Ink cartridge
7 Container
71 Ink storage portion
72 Opening
73 Screw thread (external thread)
8 Plug
9 Air tight portion (inner circumferential surface, annular rib)

The invention claimed is:

1. A writing instrument comprising:

a writing instrument body comprising a pen point at a front end of a barrel; and an ink cartridge connected to a rear end side of the writing instrument body, wherein the ink cartridge comprises a bottomed cylindrical container with an opened front end and a closed rear end and a plug fitted into an inner circumferential surface of an opening of the container, the writing instrument body comprises a projection that opens the ink cartridge when inserted into the opening of the container to press the plug rearward and a connecting portion that is formed separately from the projection and also surrounding the projection, and the writing instrument body and the ink cartridge are in a connected condition by air tight fitting the opening of the container in the connecting portion.

2. The writing instrument according to claim 1, wherein the opening of the container is divided by the projection to form a plurality of longitudinal channels in an outer periphery of the projection, wherein at least one of the channels becomes an ink channel and at least one of the other channels becomes an air intake path.

3. The writing instrument according to claim 1, wherein the projection is provided with a plurality of longitudinal grooves on an outer peripheral surface.

4. The writing instrument according to claim 3, wherein each groove has an approximately identical radial cross sectional shape.

5. The writing instrument according to claim 1, wherein the connected condition is achieved by air tight fitting an outer peripheral surface of the opening of the container in an inner side surface of the connecting portion.

6. The writing instrument according to claim 5, wherein the connecting portion is in an axially extending cylindrical shape.

7. The writing instrument according to claim 6, wherein an air tight annular rib is formed on the inner side surface of the connecting portion or on the outer peripheral surface of the opening of the container.

8. The writing instrument according to claim 5, wherein the opening of the container is divided by the projection to form a plurality of longitudinal channels on an outer periphery of the projection, at least one of the channels becomes an ink channel and at least one of the other channels becomes an air intake path.

9. The writing instrument according to claim 1, wherein an intermediate member is press fitted in the barrel in a cylindrical shape of the writing instrument body and the connecting portion is provided behind a fitting portion of the intermediate member, and a locking portion is formed on the intermediate member and also a locked portion is formed on an inner circumferential surface of the barrel, and when a rotating force is applied to the connecting portion, the locking portion makes contact with and locks the locked portion to restrict rotation of the intermediate member.

10. The writing instrument according to claim 9, wherein the locking portion and the locked portion are axially extending ribs.

11. The writing instrument according to claim 10, wherein a rotation preventing rib is formed on the intermediate member, a plurality of restricting ribs are formed radially on the inner circumferential surface of the barrel, and the rotation preventing rib is disposed between the adjacent restricting ribs.

12. The writing instrument according to claim 10, wherein a rotation preventing rib is formed on the inner circumferential surface of the barrel, a plurality of restricting ribs are formed radially in front of the fitting portion of the intermediate member, and the rotation preventing rib is disposed between the adjacent restricting ribs.

13. The writing instrument according to claim 11, wherein the restricting ribs are disposed radially at regular intervals on the inner circumferential surface of the barrel or the fitting portion of the intermediate member.

14. The writing instrument according to claim 11, wherein a plurality of rotation preventing ribs is provided and disposed radially at regular intervals on the fitting portion of the intermediate member.

15. The writing instrument according to claim 9, wherein the ink cartridge is screwed together with any one of the connecting portion, the intermediate member, and the barrel.

16. The writing instrument according to claim 1, wherein an external thread is formed in any one of an inner surface of the barrel and an outer peripheral surface of the container and an internal thread is formed in the other, and air tight fitting of the connecting portion and the opening of the container proceeds in association with screwing of the external thread together with the internal thread.

17. The writing instrument according to claim 1, wherein the pen point provided at a tip end of the barrel is a marking pen tip and an ink absorber is provided in the barrel.

18. An ink cartridge constituting the writing instrument according to claim 1, wherein the opening of the container has an inner circumferential surface, and the inner circumferential surface and an outer side surface of the connecting portion are connected and form an air tight fitting.

19. An ink cartridge constituting the writing instrument according to claim 1, wherein the opening of the container has an outer peripheral surface, and the outer peripheral surface and an inner side surface of the connecting portion are connected and form an air tight fitting.

20. An ink cartridge constituting the writing instrument according to claim 16, wherein any one of the external thread or the internal thread is formed in the outer peripheral surface of the container.

21. An ink cartridge constituting the writing instrument according to claim 17, wherein oil-based ink for writing board containing pigment, a resin, and a remover in a solvent is stored in the container.

* * * * *